United States Patent [19]

Boonants et al.

[11] Patent Number: 4,674,140

[45] Date of Patent: Jun. 23, 1987

[54] ARTICULATED BEDSPRING AND MATTRESS FOR USE WITH SUCH ARTICULATED BEDSPRING

[76] Inventors: Marius Boonants, rue du Vallon, 21, Eugies, Belgium, B-7250; Henri Biefnot, rue Lloyd George, 121, Jemappes, Belgium, B-7310

[21] Appl. No.: 648,011

[22] Filed: Sep. 6, 1984

[30] Foreign Application Priority Data

Sep. 7, 1983 [BE] Belgium ..... 0/211490

[51] Int. Cl.[4] ..... A61G 7/00

[52] U.S. Cl. ..... 5/68; 5/66; 5/72; 5/80; 5/443; 5/481

[58] Field of Search ..... 5/66–69, 5/60, 62, 70, 72, 80, 443, 481

[56] References Cited

U.S. PATENT DOCUMENTS

| | | | |
|---|---|---|---|
| 1,118,973 | 12/1914 | Troesch | 5/443 |
| 2,108,913 | 2/1938 | Bawer | 5/66 |
| 3,245,092 | 4/1966 | Kreuz | 5/68 |
| 3,974,530 | 8/1976 | Lusch et al. | 5/66 |
| 4,103,170 | 7/1978 | Spradlin | 5/67 |
| 4,277,858 | 7/1981 | Bohme | 5/66 |
| 4,403,357 | 9/1983 | Degen | 5/66 |

FOREIGN PATENT DOCUMENTS

| | | | |
|---|---|---|---|
| 781040 | 4/1972 | Belgium . | |
| 872019 | 5/1979 | Belgium . | |
| 889520 | 3/1981 | Belgium . | |
| 3017723 | 11/1981 | Fed. Rep. of Germany | 5/62 |
| 1400517 | 4/1965 | France . | |
| 596803 | 3/1978 | Switzerland . | |

*Primary Examiner*—Alexander Grosz
*Attorney, Agent, or Firm*—Weingarten, Schurgin, Gagnebin & Hayes

[57] ABSTRACT

Bedspring articulated in three parts on a chassis, a head part, a center part, and a foot part, whereof the center part is essentially composed of two adjacent platforms wherein the articulations of each of the platforms are adjustable in normal and lengthwise translation with respect to the chassis and in lengthwise translation with respect to the platform in question, at least one of the head or foot parts is adjustable in normal translation with respect to the chassis, and at least one of the head or foot parts is adjustable tiltwise with respect to the chassis.

18 Claims, 5 Drawing Figures

ARTICULATED BEDSPRING AND MATTRESS FOR USE WITH SUCH ARTICULATED BEDSPRING

The present invention relates to an articulted bedspring, in particular an articulated bedspring usable in orthopedics, principally in treating primary and secondary painful diseases of the spine.

Independently of orthopedic applications, various bedsprings intended to ensure satisfactory maintenance of the body in the lying position have already been proposed.

Among the prior solutions evisaged, patent No. BE-A-889.520 proposes an articulated bedspring provided with platforms pivoting about transverse axes parallel to the plane of the bedspring, and divided into three parts mounted on a chassis, namely a head part to receive the user's head, a center part to receive the trunk, and a foot part to receive the legs, wherein the platforms, two in number, are adjacent and disposed in the center part of the bedspring, whereby their pivoting axes divide them into two asymmetrical arms, the platforms having their shorter arms adjacent, the platform located on the head part side being longer than the platform located on the foot part side.

However, this bedspring, of which the first observations proved highly promising, proved in practice to be inadequate for lasting relief of patients with spinal problems.

What is more, observations made with medical collaboration first established that the bedspring, as disclosed in patent No. BE-A-889.520, in numerous cases caused too great a thrust by the platforms and also brought about stresses in the spinal column such that the pain relief initially achieved decreased with time, and fresh pains arose from the stresses generated.

These observations demonstrated the importance of absolutely correct positioning, for a given user, of the pivot axes of the platforms on the platforms themselves, as well as the spacing between the platforms. Moreover, contrary to the teaching of patent No. BE-A-889.520, wherein the various head, center, and foot parts are all located at the same height, the importance of the relative heightwise placement of these various parts with respect to each other was also shown.

Medical investigations carried out jointly with the research aimed at modifying a bedspring of the type mentioned hereinabove first of all showed that patients obtained true and lasting relief when the arrangement of the platforms and the relative heightwise and tiltwise positions of the various parts of the bedspring with respect to each other were precisely adapted to the body structure of the patient.

These medical investigations were subsequently directed to a new treatment which took advantage of nocturnal rest to apply gradual corrective stresses to appropriate parts of the spinal column leading not only to relief of nocturnal pain but also to rehabilitation toward a more correct spinal posture.

The object of the present invention is to furnish a bedspring permitting application of this new treatment, from which a favorable influence on the development of spinal diseases is expected.

Another goal of the invention is to furnish such a bedspring adaptable at will to the body structure and condition of the patient.

Still another goal of the invention is to furnish a mattress usable with such a bedspring to cooperate with the latter as effectively as possible, while ensuring great comfort for the user.

These goals are achieved by designing an articulated bedspring divided into three parts mounted on a chassis, namely a head part to receive the user's head, a center part to receive the trunk, and a foot part to receive the legs, the center part being essentially composed of two adjacent platforms, the platform located on the head part side being longer than the platform located on the foot part side, wherein the articulations of each of the platforms are adjustable in normal and lengthwise translation with respect to the chassis and in lengthwise translation with respect to the platform in question, at least one of the head or foot parts is adjustable in normal translation with respect to the chassis and at least one of the head or foot parts is adjustable tiltwise with respect to the chassis.

According to another characteristic of the invention, the head part is adjustable heightwise and tiltwise with respect to the chassis, the platforms are mounted on supports with articulations adjustable lengthwise and heightwise with respect to the chassis and lengthwise with respect to the platforms, the foot part is composed of an anterior element and a posterior element which are disposed angularly with respect to each other, this angular position being provided independently of the position of the adjacent platform, said foot part being adjustable heightwise and tiltwise with respect to the chassis, and at least one of the head or foot parts is in addition adjustable lengthwise with respect to the chassis.

According to yet another characteristic of the invention, the head part is mounted at the anterior ends of the pivoting arms articulated on the chassis by their posterior ends, the supports of the platform adjacent to the head part being themselves mounted lengthwise- and heightwise-adjustably on these arms, at a point close to the posterior ends of said arms.

According to another characteristic of the invention, the platform adjacent to the head part has, at a point close to the pivoting zone, a support head recessed with respect to the other support parts of the platform.

According to yet another characteristic of the invention, the anterior element and the posterior element of the foot part are assembled rigidly to each other in a given angular position.

According to yet another characteristic of the invention, the anterior element of the foot part is articulated to a support adjustable lengthwise and heightwise with respect to the chassis, and the posterior element of the foot part rests, by means of a rod, on a rack integral with the chassis.

According to yet another characteristic of the invention, one of the elements of an articulated support is composed of a part of a gusset provided with a resting element on the chassis and provided with a horizontal slot for passage of a connecting element to the chassis, and a vertical slot adjacent to a guide, and on the other hand with a slide, also provided with a slot, and designed to move along the guide on the gusset, the vertical slot of the gusset and the slot of the guide being aligned in this position to permit passage of a common connecting element, the slide bearing one element of an articulation, extending perpendicularly to said slide, on the face of the latter opposite the face coming in contact with the gusset, and the other element of the articulated support is composed of a section which at least partially matches the shape of a lateral element of the platform, said section being provided with a lengthwise slot for passage of a connecting element to the lateral element of the platform, and bearing the complementary element of the articulation.

According to yet another characteristic of the invention, a mattress designed to be used with a bedspring to the invention is composed of a slab of high-density flexible plastic foam surmounting by a slab of low-density flexible plastic foam, each of these slabs being contained in an envelope of fabric possessing sufficient sliding properties to permit movement of one slab with respect to the other, the whole being enclosed in a cover to constitute a single structure.

These characteristics and others will emerge more clearly from the description and drawing hereinbelow which represents, solely as an example, various embodiments of the invention, wherein.

Figure 1:
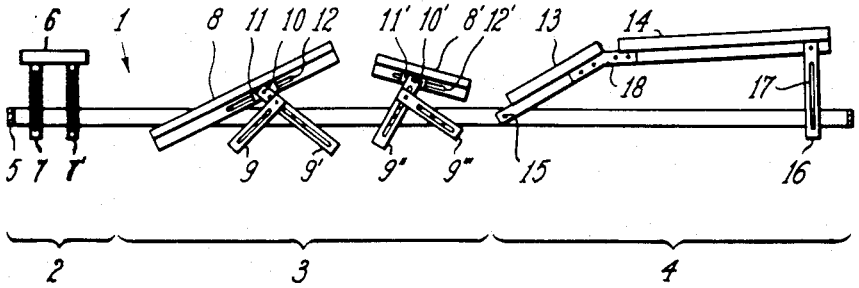
FIG. 1 is a schematic profile view of one embodiment of a bedspring according to the invention.
Figure 3:
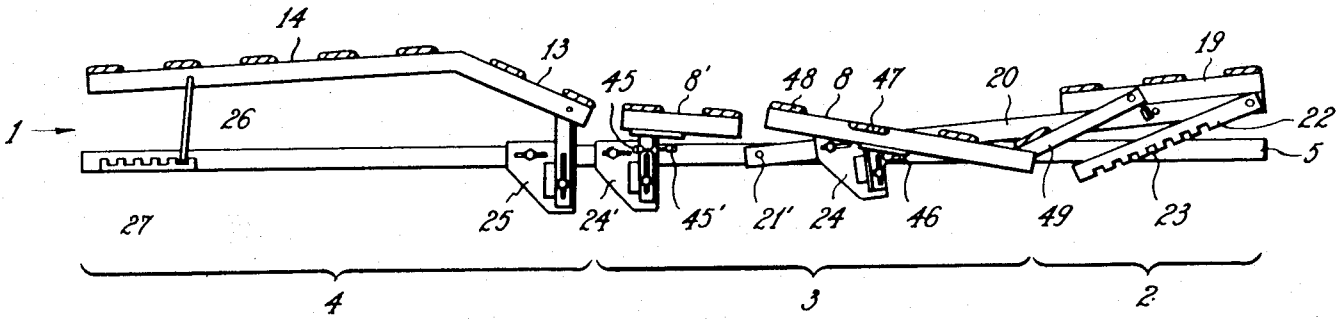
FIG. 3 is a profile view of a preferred embodiment of a bedspring according to the invention.

According to the embodiments shown in FIGS. 1 and 3, a bedspring 1 comprises a head part 2 to receive the user's head, a center part 3 to receive the trunk, and a foot part 4 to receive the legs. The various elements of these head, center, and foot parts are mounted on a chassis 5.

Referring to the simplified embodiment shown in FIG. 1, a support element 6 of head part 2 is integral with bars 7, 7' which can move vertically with respect to chassis 5 and can be locked into position with respect to the latter.

Two platforms 8, 8', which constitute the center part, are each mounted on the chassis by means of two bars 9, 9' or 9'', 9''', provided with slots, and made adjustably integral with each other and with the chassis at three points in order to form an adjustable triangulate system with the chassis. In this way, the ends of each of bars 9' and 9'', which bear an element of an articulation 10 or 10', are movable with respect to the chassis in a translational motion with a normal and/or lengthwise component and, after reaching the required position, are lockable in this position.

The second element 11 or 11' of the articulation is able to move lengthwise in a slot 12, 12' with respect to platform 8, 8' and to be locked in this position. Thus, continuous adjustment is obtained, within given limits, of the location of the platforms with respect to the chassis and of the position of the pivoting point of the articulation on the platforms. These limits can be broadened, notably with respect to the attachment to the chassis, by providing on the chassis various possible locations for attachment of bars 9, 9' and 9'', 9'''.

Foot part 4 is composed of an anterior element 13 and a posterior element 14 which are assembled at an angle to one another. Anterior element 13 is pivotably mounted on the chassis at 15 while posterior element 14 is supported by a bar 16 wherein a slot 17 is formed to permit adjustment of the inclination of foot part 4 with respect to the chassis. In this embodiment, the angular position of anterior element 13 with respect to posterior element 14 is provided by a bent connecting element 18 which provides the link between said anterior element 13 and posterior element 14.

According to this simplified embodiment, head part 2 is adjustable heightwise, the location of each platform 8, 8' is adjustable separately heightwise and lengthwise, the position of the pivoting point of each platform on its support is adjustable lengthwise with respect to the platform, and the position of foot part 4 is adjustable tiltwise with respect to the chassis.

In this way, the arrangement of the platforms can be modified for a given patient—without changing their position with respect to the chassis—by changing the locations of the pivoting points of said platforms on their supports, then by bringing the platforms back into their original position with respect to the chassis. The height adjustment modification—for head part 2—and tilt adjustment—for foot part 4, combined with adjustment of platforms 8, 8' of the center part, enable the spinal column of the individual concerned to assume all positions required with a view to dynamic rehabilitation into a more correct spinal posture.

According to the preferred embodiment of the invention shown in FIG. 3, head part 2 is composed of a support element 19 mounted at the end of a frame 20 articulated to the chassis at 21'. This support element 19 is adjustable tiltwise and heightwise with respect to the chassis by means of a rack 22, articulated to the anterior end of frame 20 and cooperating with a pin 23 integral with chassis 5.

Platforms 8, 8' are mounted respectively on frame 20 and on chassis with the aid of articulated supports 24, 24' which will be described in greater detail hereinbelow with reference to FIS. 2*a* and 2*b*.

Figure 2A:
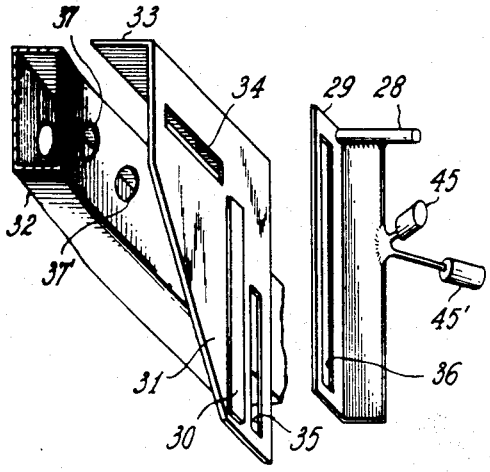
FIGS. 2*a* and 2*b* are perspective views of a preferred embodiment of the elements of an articulated support usable on a bedspring according to the invention.

Finally, foot part 4 is mounted on chassis 5, at its anterior part, by a support 25, of the same type as that illustrated in FIG. 2*a*, and at its posterior part by a rod 26 which rests on a rack 27 integral with the chassis.

Figure 2B:
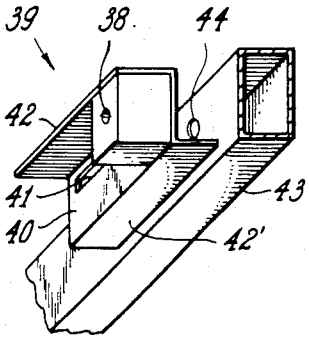

A preferred embodiment of an articulated support like supports 24, 24' is shown in FIGS. 2*a* and 2*b*.

According to this embodiment, an element 28 of an articulation is essentially supported by a slide 29 moving along a vertical guide 30 integral with a gusset 31. Gusset 31 is designed to be joined to a tubular element 32 constituting the structure of either chassis 5 or frame 20, and has at its upper part a flange 33 which constitutes the support element on tubular element 32. A horizontal slot 34 and a vertical slot 35 are formed in gusset 31, while slide 29, designed in an L-shape, has a vertical slot 36. Horizontal slot 34 is designed to cooperate with a hole 37 for passage of an element connecting gusset 31 to tubular element 32, while slots 35 and 36 are designed to cooperate to permit passage of an element connecting slide 29 to gusset 31. Matching holes 37' enable the distance along which gusset 31 can be positioned on tubular element 32 to be increased. Thus, articulation element 28, in this case an articulation pin, can undergo a translation with a normal and/or lengthwise component with respect to tubular element 32.

A matching element 38 of the articulation, in this case an articulation bearing, is supported by a section 39 whose web 40, provided with a slot 41, is adjacent to two stiffening flanges 42, 42'. Web 40 is designed to contact one face of a tubular element 43 constituting the lateral element of one of platforms 8, 8'. Slot 41 is designed to cooperate with a hole 44 in said tubular element 43 to permit lengthwise positioning of section 39, and hence of matching element 38 of the articulation with respect to the platform in question.

According to the preferred embodiment of the support according to the invention shown in FIG. 2*a*, slide 29 has stops 45, 45' designed to limit the movement of the platforms. Platform support 8, adjacent to the head end, can comprise a single stop 46 as shown in FIG. 3.

According to a preferred embodiment of the invention, platform 8 adjacent to the head end comprises, near its center region, a support part which is recessed to receive the projecting shoulder blades. Despite the use of appropriate mattresses, this is an important element for the patient's comfort. In the embodiment shown in FIG. 3, this recessed support pad is composed of a transverse slat 47 recessed with respect to the other slats 48 of the structure. One could however also provide a continuous support having a recessed part obtained, for example, by molding. A flap 49 forms the transition between the support element 19 and platform 8.

In the embodiment shown in FIG. 3, the angular arrangement of anterior element 13 and of posterior element 14 of the foot part is obtained by welding.

Indeed, the connection between anterior element 13 and posterior element 14 of the foot part is designed to be located at the user's knee, so that anterior element 13 of the foot part forms a support for the user's thigh.

Surprisingly, it has been found that the angle between anterior element 13 and posterior element 14 of the foot part, resulting from a compromise between the angle required to ensure an absolutely correct position on the part of the user when lying on his side and that required when lying supine, ensures a satisfactory position of the user in both positions, such that this angle can be fixed definitively for a given individual. The angular position of anterior element 13 with respect to posterior element 14 of the foot part is thus set independently from the adjacent platform. In addition, this angle constitutes a positioning element which automatically ensures an invariable position of the user in the lengthwise direction of the bedspring, this invariable position guaranteeing correct operation of the platforms at all times.

Of course, assemblies known to the individual skilled in the art to ensure, between two parts, an adjustable angular link lockable into a given position are also part of the scope of the present invention.

Figure 4:
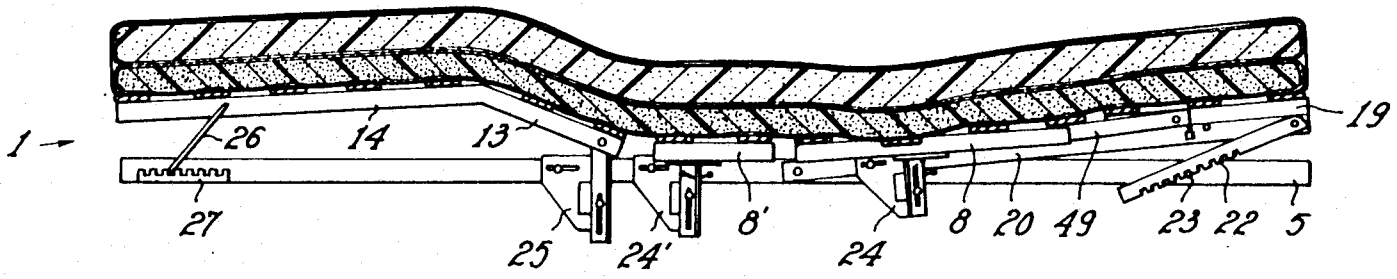
FIG. 4 is a profile view of a preferred embodiment of a mattress being used with the embodiment of the bedspring of FIG. 3 according to the invention.

Finally, referring to FIG. 4 it should be pointed out that a particularly appropriate mattress for such a bedspring is composed of a slab of high-density flexible plastic foam 60 designed to provide the patient with firm support, surmounted by a slab of low-density flexible plastic foam 62 designed to ensure the patient's comfort. For these two mattress elements to perform their functions, it is essential for them both to be enclosed in an envelope 60; 62' respectively of fabric having sufficient sliding properties for the two slabs to be able to guide against each other according to the deformations to which they are subjected, these two slabs and their envelopes being contained in a common cover 64 to form a single structure.

Preferably, a 60 to 90 kg/m$^3$ polyurethane foam 3 to 6 cm thick will be used for the high-density flexible plastic foam slab and a 20 to 50 kg/m$^3$ polyurethane foam 6 to 10 cm thick for the low-density flexible plastic foam slab.

The envelope in which each of these foam slabs is enclosed can be made of any fabric with the sliding and wear resistance properties required, such as nylon knit, polyamide, etc.

For the mattress also to be able to perform its firm support and user comfort functions as correctly as possible, it is desirable for it to be adapted to the weight of the user. Of course, the slab thickness required will be a function of the density of the foam used.

Thus, for example, for a mattress with a total thickness of 10 cm and a user weighing about 70 kg, a slab of 75 kg/m$^3$ polyurethane foam 4 cm thick and a slab of 25 kg/m$^3$ foam 6 cm thick will be used, while for a user weighing 80 to 90 kg, a slab of 75 to 80 kg/m$^3$ polyurethane foam 4 cm thick and a slab of 40 kg/m$^3$ polyurethane foam 6 cm thick will be used.

The same result can be obtained by using higher-density materials of lesser thickness or, conversely, lower-density materials of greater thickness. Thus, particularly with regard to the low-density slab, for a user weighing about 70 kg, a 20 kg/m$^3$ polyurethane foam slab 10 cm thick has also proved to be very satisfactory.

The invention was described and illustrated as a non-limitative example, and it goes without saying that numerous modifications can be made to its implementation without departing from its spirit.

We claim:

1. An articulated bed for aligning and correcting the alignment of the spine of a human user, comprising:

an elongated chassis;

a head part for receiving the users head;

a center part for receiving the users trunk;

a foot part for receiving the users legs;

said center part consisting of adjacent first and second platforms, the first platform being located proximate the head part and the second platform be located proximate the foot part, the first platform, located proximate head part, being longer than the second platform, located proximate the foot part;

a first articulation for rotatably mounting said first platform about a first pivot axis generally transverses the direction of elongation of said chassis;

a second articulation for rotatably mounting said second platform about a second pivot axis generally transverse to the direction of elongation of said chassis;

first means coupled to said first articulation for selectively adjusting the position of said first pivot axis both in normal and lengthwise translation with respect to the chassis and in lengthwise translation with respect to said first platform and for maintaining the first pivot axis in the selection position; and second means coupled to said second articulation for selectably adjusting the position of said second pivot axis both in normal and lengthwise translation with respect to the chassis and in lengthwise translation with respect to said second platform and for maintaining the second pivot axis in the selected position.

2. The invention of claim 1, further including a third articulation for joining said head part to said chassis, and third means coupled to said third articulation for adjusting the position of said third articulation in normal translation with respect to said chassis.

3. The invention of claim 1, further including a fourth articulation for joining said foot part to said chassis, and fourth means coupled to said fourth articulation for adjusting the position of said foot part in normal translation with respect to said chassis.

4. The invention of claim 2, wherein said third means further includes means coupled to said third articulation for adjusting the position of said head part tiltwise with respect to said chassis.

5. The invention of claim 3, wherein said fourth means coupled to said fourth articulation further includes means for adjusting the position of said foot part tiltwise with respect to said chassis.

6. The invention of claim 1, wherein said foot part includes an anterior element and a posterior element disposed in a predetermined angular orientation with respect to each other.

7. The invention of claim 6, further including a fifth articulation for joining said foot part to said chassis, and fifth means coupled to said fifth articulation for adjusting the position of said foot part heightwise and tiltwise with respect to said chassis.

8. The invention of claim 7 wherein said fifth means futher includes means for adjusting the position of said foot part lengthwise with respect to said chassis.

9. The invention of claim 1, further including a sixth articulation for joining said head part to said chassis, and sixth means coupled to said sixth articulation for adjusting the position of said head part heightwise and tiltwise with respect to said chassis.

10. The invention of claim 9, wherein sixth means further includes means for adjusting the position of said head part lengthwise with respect to said chassis.

11. The invention of claim 9, wherein said sixth means includes a pair of pivoting arms having anterior and posterior ends, said head part being mounted to said anterior ends of said pivoting arms, said posterior ends of said pivoting arms being joined to said chassis by said sixth articulation, and wherein said first means and said first articulation are themselves mounted on said pair of pivoting arms, at a location near the posterior ends of said arms.

12. The invention of claim 1, wherein said first platform includes a surface having a shoulder blade receiving recess along a portion of said surface thereof proximate said first pivot axis.

13. The invention of claim 6, wherein said anterior and posterior elements of said foot part are rigidly assembled together in said predetermined angular orientation.

14. The invention of claim 1, wherein said foot part includes an anterior element and a posterior element being assembled together in a predetermined angular orientation, a seventh articulation for for joining said anterior element of said foot part to said chassis, and seventh means coupled to said seventh articulation for adjusting the position of said articulation in lengthwise and heightwise translation with respect to said chassis.

15. The invention of claim 14, further including a rack integral with the chassis, and a rod, extending from the posterior element of said foot part, adapted to rest in said rack.

16. The invention of claim 1, wherein each of said first and said second means includes a gusset including a chassis receiving support element, and further including a horizontal slot for passage therethrough of a connecting element to said chassis; said gusset further including a vertical slot adjacent to a guide; a slide having a slot; said slide cooperative with said gusset to move along said guide of said gusset, the vertical slot of said gusset and the slot of said slide being aligned to permit passage of a common joining element, the slide carrying an element of an articulation, extending perpendicularly to said slide, and on the face of the slide opposite the face in contact with the gusset; and further including an articulated bearing member including a section that partially matches the shape of the side of each of said first and second platforms, said section including a lengthwise slot for passage of a connecting element to the lateral element of said first and second platforms, and bears the matching element of the corresponding articulation.

17. The invention of claim 1, further including a mattresss consisting of a slab of high-density flexible plastic foam surmounted by a slab of low-density flexible plastic foam, and further including an envelope of fabric possessing sliding properties enabling one slab to move with respect to the other, said first and second slabs being enclosed in a cover.

18. The invention of claim 17, wherein said slab of high-density flexible plastic foam is a slab of polyurethane foam with a density of from 60 to 90 kilograms per cubic meter and with a thickness of 3 to 6 centimeters, and said slab of low-density flexible plastic foam being a slab of polyurethane foam with a density of between 20 to 50 kilograms per cubic meter and with a thickness of from 6 to 10 centimeters.

* * * * *

UNITED STATES PATENT AND TRADEMARK OFFICE

CERTIFICATE OF CORRECTION

PATENT NO. : 4,674,140

DATED : June 23, 1987

INVENTOR(S) : Marius Boonants; Henri Biefnot

It is certified that error appears in the above-identified patent and that said Letters Patent is hereby corrected as shown below:

Column 2, line 43, "support head" should read --support part--

Column 3, line 8, "bedspring to" should read --bedspring according to--
line 10, "surmounting" should read --surmounted--

Column 4, line 33, "chassis with" should read --chassis 5 with--

Column 5, line 56, "envelope 60; 62' " should read --envelope 60', 62'--

Column 6, line 30, "users head;" should read --user's head;--
line 31, "users trunk;" should read --user's trunk;--
line 32, "users legs;" should read --user's legs;--
line 35, "be" should read --being--
lines 40-41, "trans- verses" should read --trans- verse--

Column 7, line 26, "wherein sixth" should read --wherein said sixth--

Column 8, line 2, "for for" should read --for--

Signed and Sealed this

Fifteenth Day of November, 1988

*Attest:*

*Attesting Officer*

DONALD J. QUIGG

*Commissioner of Patents and Trademarks*